US010562600B2

(12) United States Patent
Garcia Diaz

(10) Patent No.: US 10,562,600 B2
(45) Date of Patent: Feb. 18, 2020

(54) MACHINE FOR CLEANING BOAT HULLS IN THE WATER

(71) Applicant: Justo Garcia Diaz, Madrid (ES)

(72) Inventor: Justo Garcia Diaz, Madrid (ES)

( * ) Notice: Subject to any disclaimer, the term of this patent is extended or adjusted under 35 U.S.C. 154(b) by 0 days.

(21) Appl. No.: 15/668,718

(22) Filed: Aug. 4, 2017

(65) Prior Publication Data

US 2019/0039701 A1 Feb. 7, 2019

(51) Int. Cl.
*B63B 59/00* (2006.01)
*B63B 59/08* (2006.01)

(52) U.S. Cl.
CPC ..... *B63B 59/08* (2013.01)

(58) Field of Classification Search
CPC ... B63B 59/06; B63B 2059/065; B63B 59/08; B63B 2059/082; B63B 2059/085; B63B 2059/087; B63B 59/10
See application file for complete search history.

(56) References Cited

U.S. PATENT DOCUMENTS 4,007,701 A * 2/1977 Fike ..... B63B 59/08 114/222
4,043,286 A * 8/1977 Doty ..... B63B 59/08 114/222
4,236,477 A * 12/1980 Norris ..... B63B 59/08 114/222
5,638,764 A * 6/1997 Sarvela ..... B63B 59/08 114/222
2007/0079743 A1* 4/2007 Hudd ..... B63B 59/08 114/222
2008/0282956 A1* 11/2008 Morace ..... B63B 59/08 114/222

* cited by examiner

*Primary Examiner* — Andrew Polay

(57) ABSTRACT

A machine for cleaning boat hulls in the water, with a U-shaped structure (2), submerged in the water and fastened to a jetty or dock, that incorporates rollers (4), fastened to lateral frames (3), driven by motors (5), grouped with mobility and flotation in parallel rows (6), in order to slide perpendicularly along the length of the hull, in one direction or the other, adapting to its shape. The lateral frames (3) are mobile in the vertical sense. The rollers (4) are incorporated in floating cages. The structure (2) has a vertical movement mechanism (18) to adapt it to the draft and/or with a horizontal movement mechanism (21) to move it under the boat or it is fixed, with the boat being moved by a winch.

13 Claims, 6 Drawing Sheets

MACHINE FOR CLEANING BOAT HULLS IN THE WATER

PURPOSE OF THE INVENTION

The invention, as the statement of the descriptive report expresses, refers to a machine for the cleaning of boats hulls in the water. It contributes, to the function for which it is designed, advantages and characteristics which are described in further detail later, and which signify a noteworthy novelty in the current state of the art.

More specifically, the purpose of the invention is focussed on a machine that cleans the submerged part of the hull, also called underwater body work, of the boats, particularly motor boats and pleasure boats. It cleans the algae, the slime and even descales barnacles, and it also gathers the waste in a submerged tray for its later processing and dumping. In this way it avoids the inconvenience of taking the boat to dry dock and having to apply the costly and toxic antifouling paint to it every year, since with an adequate cleaning maintenance with this machine, it is not necessary.

FIELD OF APPLICATION OF THE INVENTION

The field of application of this invention is framed within the maritime industry, concentrating particularly in the area of the boat hull cleaning systems.

BACKGROUND OF THE INVENTION

As it is well known, organisms become incrusted on all boats, due to being in contact with water, especially the sea, and form a layer that has to be eliminated from time to time to avoid problems in navigation and deterioration of the hull itself.

Up to now, either the boat had to be taken out of the water to proceed with this cleaning, which means, in addition to time, a high cost by the companies that provide these services if it cannot be done by oneself, or the boat has to be cleaned by hand, submerging oneself in the water, although this system, besides being cumbersome and difficult for the majority of users, is not usually effective unless it is done very often.

Moreover, to avoid the formation of this layer of organisms stuck to the hull, at least during a season, and to avoid a more frequent cleaning than what is necessary, special antifouling paints are often used whose inconvenience is their toxicity.

The objective of the invention is, then, to avoid these inconveniences and develop a machine that carries out the described cleaning of the boat hulls simply and, above all, practically, in which it is not necessary to take the boat out of the water and the method can be used as often as one wishes.

In addition, and as reference to the current state of the art, it can be pointed out that no other machine or invention is known, at least by the applicant, with a similar application that presents technical, structural and constitutive characteristics that are equal or similar to those of the invention that is claimed herein.

EXPLANATION OF THE INVENTION

The machine for the cleaning of the boat hull while in the water that this invention proposes is configured as a noteworthy novelty within its field of application, since according to its implementation and specifically it satisfactorily fulfils the previously indicated objectives, with the characterising details that make it possible and that appropriately distinguish it being reflected in the final claims that accompany this description.

Specifically, what the invention proposes, as noted earlier, is a machine that washes the submerged part of the boat hull without the need to take it out or raise it from the water and in addition it gathers the extracted dirt and waste in a tray for its later processing and appropriate disposal.

To do this, and more specifically, the machine is configured, essentially, from a support structure that is installed submerged in the water, conveniently fastened to a jetty or dock, to which is attached, by means of frames made mobile by a hydraulic system, a set of rollers driven by corresponding motors. These rollers, grouped in parallel rows, slide perpendicularly along the length of the hull, adapting to its shape, in order to brush it and thus eliminate the dirt and organisms incrusted on its surface.

The machine has, therefore, a very simple operation: the boat is placed, centring it on the rollers and these go spinning along the hull, brushing it and removing any element stuck to it.

Preferentially, the rollers have a base that makes them float, specifically they are arranged, connected to the cages of the floating base, which makes them always tend to go up towards the surface and, therefore, they adapt to the shape of the interior profile of the hull.

In addition, these cages, which are joined together to make up the cited rows of rollers, have movable connection systems that cause them to adapt to the different design profiles of the hulls.

Furthermore, also in a preferred manner, the structure in which the rollers are incorporated is anchored to a floating jetty or fixed mooring point depending on the case, with limited means of vertical sliding in order to adapt to the different deeper drafts.

It should be pointed out, in addition, that the machine considers two distinct variants with two movement systems. One, in which the machine has a winch that pulls the boat in order to move it lengthwise and make it pass over the rollers fastened to the structure, which are fixed to the dock or jetty, and another in which the structure of the machine with the rollers is that which moves under the boat along the hull by means of a hydraulic motor manually driven by a lever, having provided, in this case, some rails that serve as guides in this movement.

In any case, the rollers or rotating brushes are driven by hydraulic motors, activated by some levers, which generate few revolutions but with great torque, in order to be able to remove the incrustations without problems, and which, in turn are driven by an electric pump that makes the hydraulic liquid move through the circuit.

The described machine for the cleaning of boat hulls in the water represents, then, an innovation of structural and constitutive characteristics unknown until now, reasons that along with its practical use, give it sufficient basis for obtaining the privilege of exclusivity that is requested.

DESCRIPTION OF THE DRAWINGS

In order to complement the description that is being made and to aid a better understanding of the characteristics of the invention, this descriptive report is accompanied, as an integral part thereof, by a set of plans in which, as an illustrative but not limiting character, the following has been represented.

PREFERRED REALISATION OF THE INVENTION

Figure 1:
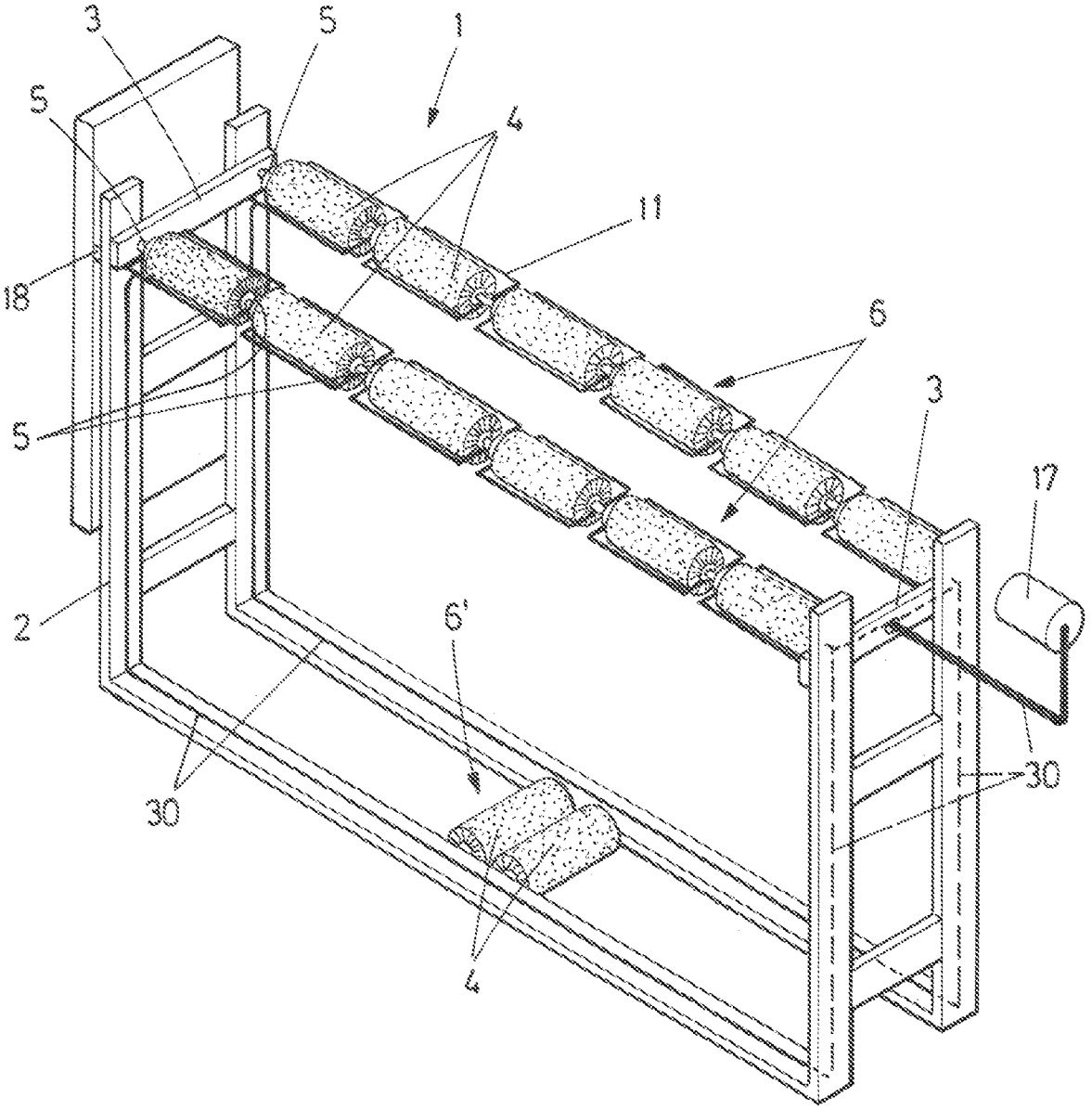
FIG. 1—It shows a schematic perspective view of an example of the realisation of the machine subject of the invention, noting the principal parts and elements that comprise it, as well as its configuration and layout.
Figure 2:
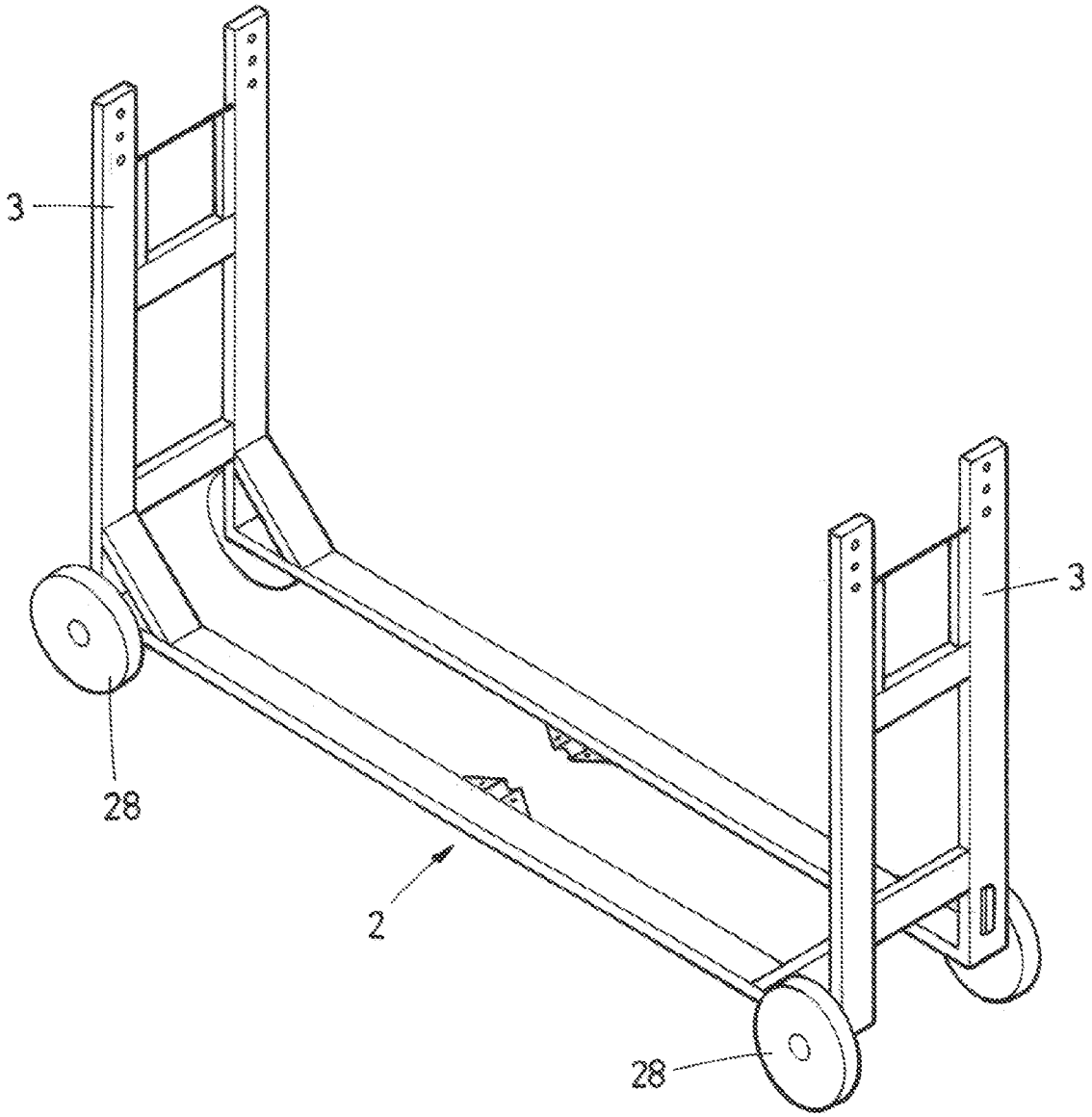
FIG. 2—It shows a schematic perspective view of the support structure that the invented machine has for holding the rollers, noting the parts and elements that form it, as well as their configuration and layout.

In view of the mentioned figures, a non-limiting realisation of the invention can be observed, which includes the parts and elements that are indicated and described in detail below, in accordance with the numeration adopted according to the following list:

1. machine
2. structure
3. frames
4. rollers
5. hydraulic motors
6. rows
7. hydraulic cylinder
8. axles
9. slots
10. enlargement
11. cages
12. floating base
13. articulated connection
14. sliding guides
15. anchorage
16. universal joint
17. electric motor
18. vertical movement mechanism
19. upper flotation stop
20. depth stop
21. horizontal movement mechanism
22. rail
23. prolonged support
24. support wheels
25. pinion
26. additional motor
27. guide beams
28. towing wheels
29. protections
30. hydraulic circuit Therefore, as observed in these figures, the machine (1) in question is configured, essentially, from a structure (2) with an approximate U shape, apt for being installed under water, fastened to the jetty or dock, that incorporates, subject to respective lateral frames (3), a set of rollers (4) that rotate driven by corresponding motors (5), grouped with mobility and flotation means in their parallel rows (6) in such a way that, by activating the machine (1), they slide perpendicularly along the length of the hull, adapting to its shape, brushing in one direction or the other as many times as is desired.

Figure 9:
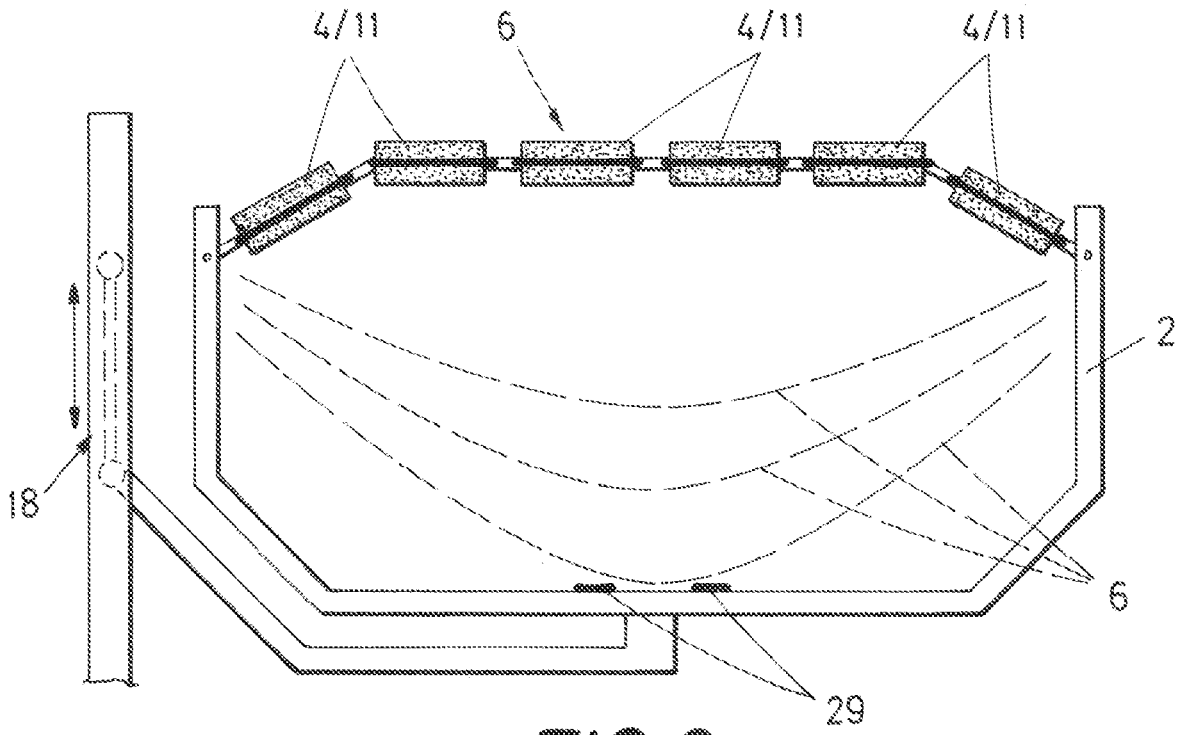
FIG. 9—It shows a front elevation view of another example of the invented machine, in this case with the means to couple the structure to the dock with vertical movement, where it also shows the positions of the rows of rollers upon adapting to the boat hull.

In FIG. 9, this adaptation of the rows (6) of rollers (4) to the shape of the boat hull has been represented.

Figure 3:
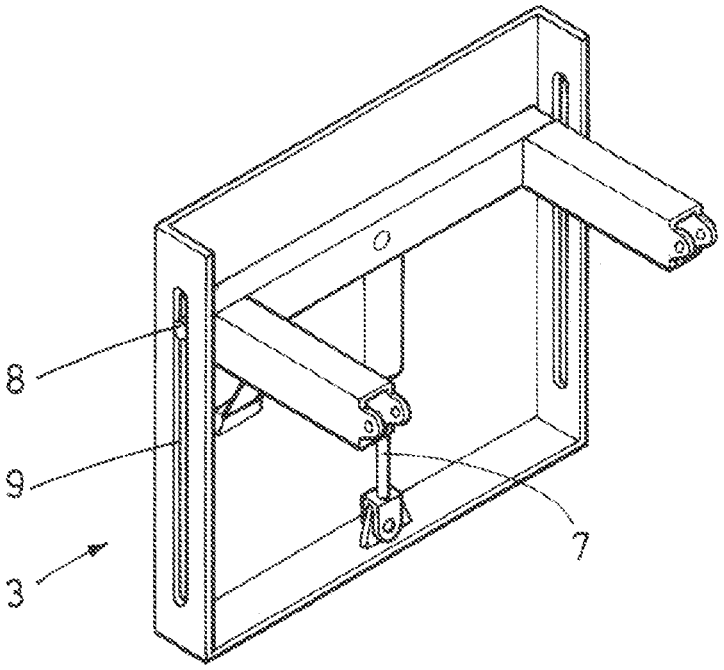
FIG. 3—It shows a perspective view of one of the hydraulic frames that hold the cages of the rollers.
Figure 4:
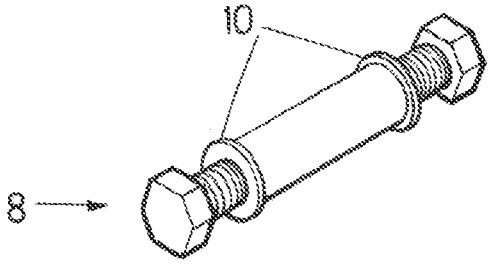
FIG. 4—It shows a close-up of the axles with which the frames are fastened to the stanchions of the structure, designed to impede their leaving the slot through which they slide.

Preferentially, the lateral frames (3), observed in the details in FIG. 3, are vertically mobile thanks to a hydraulic cylinder (7) and being anchored in articulated manner, on some axles (8) inserted in respective slots (9) of the in stanchions of the frame (2).

In this way, both rows (6) of rollers (4) move up and down in the stanchions of the structure (2), adapting to the shape of the hull. To impede that these axles (8) leave the slots (9) due to the movement, the bolt that conforms them presents, on both ends, an enlargement (10).

Preferentially, the rollers (4) are floating, for which reason they are each connected to a cage (11) that has a lower base of floating material (12).

Figure 5:
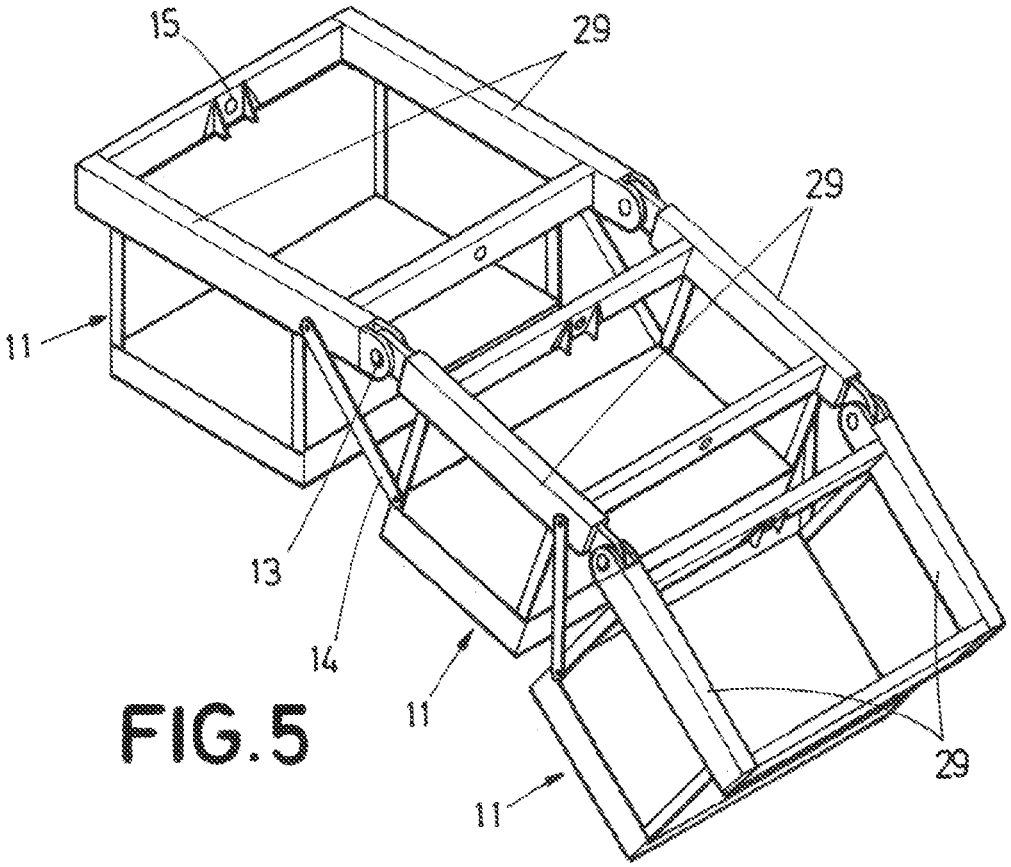
FIG. 5—It shows a perspective view of several of the floating cages in which the rollers are coupled.
Figure 14:
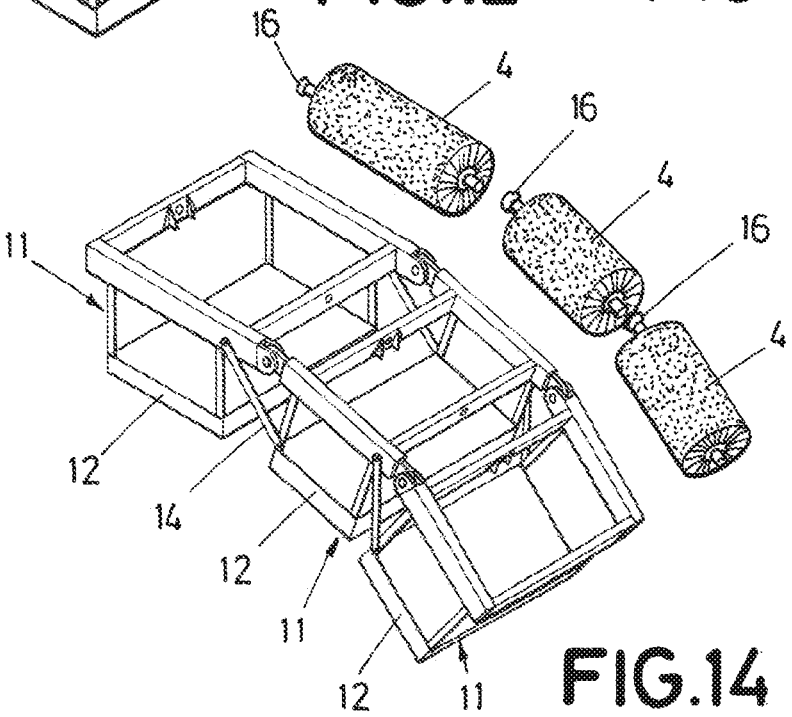
FIG. 14—It shows a view of various cages and rollers coupled together.

In addition, these cages (11) are connected together, to make adaptable rows (6) of rollers held by their ends to the lateral frames (3) of the structure (2) by means of movable connections. Specifically, as observed in FIGS. 5, 6 and 14, by means of a single articulated connection (13) provided on each side of the upper part of the framework that constitute them, and some sliding guides (14) that, also on each side, link the upper part of the cage (11) to the lower part of the next one, allowing the independent swinging of each one.

Figure 6:
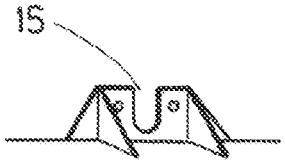
FIGS. 6 and 7—They show views of the fixing points for the motor in the cages.
Figure 7:
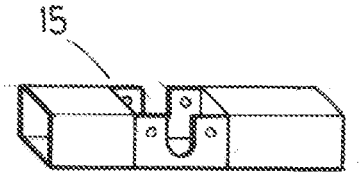
Figure 8:
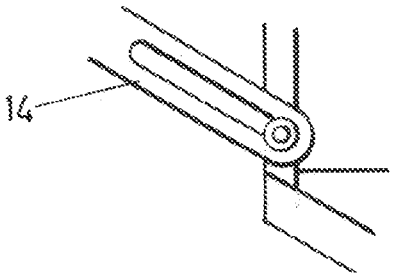
FIG. 8—It shows an expanded detail of the articulated connection between cages to allow their independent movements in the water.

In the FIGS. 1, 6 and 7, it is observed how, in addition, in the cited framework of each cage (11) an anchorage point (15) has been provided, centred on a bar of the front part, for the fastening of the motor (5) that drives the roller (4), which, in turn, is coupled to the motor (5) by means of a universal joint (16) at one end and at the other to a bar from the back part, with all the rollers (4) remaining in both rows (6) with their motors (5) aligned axially.

Preferably, the motors (5) of the rollers (4) are hydraulic, and to improve their power, the system has an electric motor (17), represented in FIG. 1, which moves a hydraulic circuit (30) which gives power to the hydraulic motors (5) of the rows (6) of rollers (4) individually to each one by means of a manual control system of levers (not represented).

In the preferred realisation, the structure (2) has the two already described transverse rows (6) that have six rollers (4) each, fastened on their ends to the lateral frames (3) and, additionally, with another longitudinal row (6'), with two more rollers (4), fastened in the centre of the lower section of the structure (2).

Figure 10:
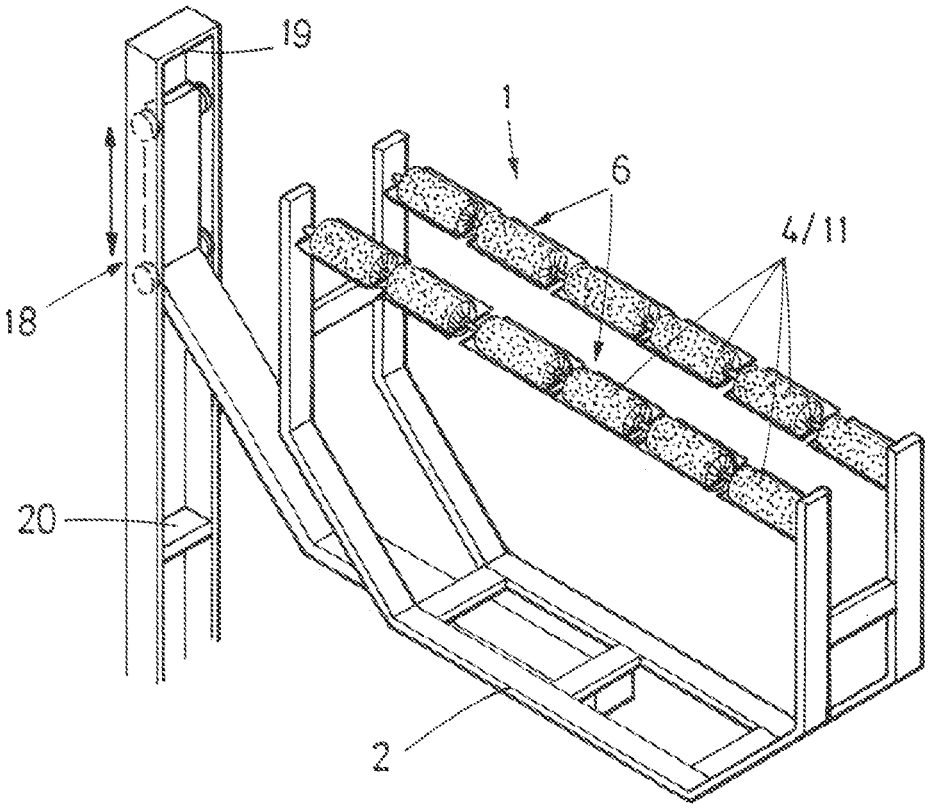
FIG. 10—It shows a perspective view of the example of the invented machine shown in FIG. 9.

Continuing with the characteristics of the machine (1), also in the preferred mode, the structure (2) is anchored to a floating jetty or to a fixed mooring, depending on the case, by a vertically sliding mechanism (18), examples of which can be seen in FIGS. 9 and 10, in order to adapt its position to different drafts, being able to consist of, for example, a skid with bearings (FIG. 9) or a guide cylinder (FIG. 10). In any case, this vertically sliding mechanism (18) has, preferably, an upper flotation stop (19) and a depth or draft stop (20).

Thus, once the boat is situated on the machine (1) where its draft requires it to butt against the lower part of the structure (2) by situating it on the rollers (4), the vertically sliding mechanism (18) is activated to lower the structure (2) to the necessary depth that is suitable for the draft and allows the sliding of the rollers along its hull.

In this option, preferably, it is the boat that moves on the rollers (4), preferably by means of a winch (not represented) which pulls it forwards and backwards, allowing this movement as many times as appropriate until achieving the cleaning of the hull.

Figure 11:
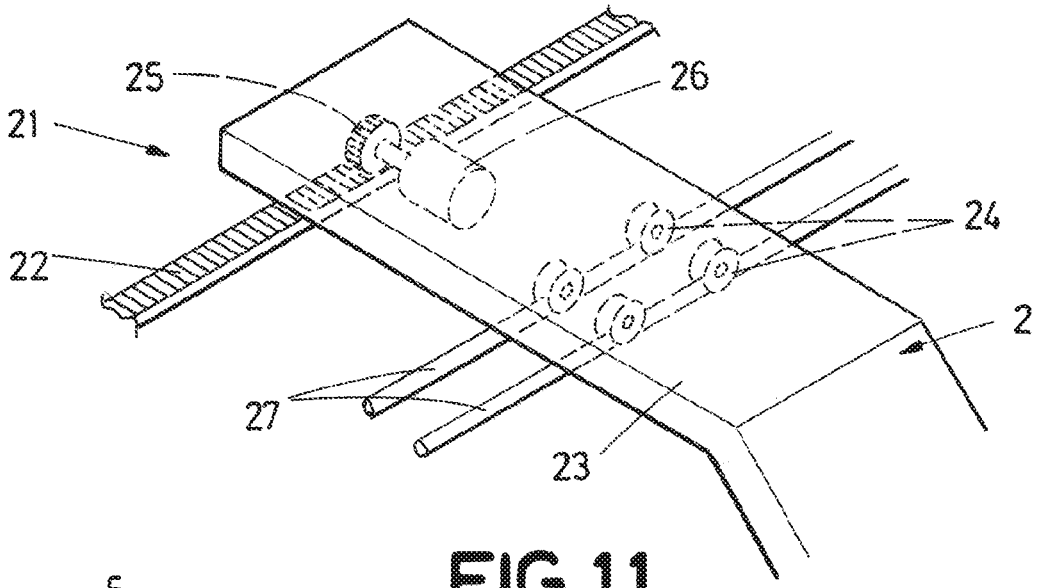
FIG. 11—It shows a schematic representation in perspective of an example of rails for the horizontal movement of the machine.
Figure 12:
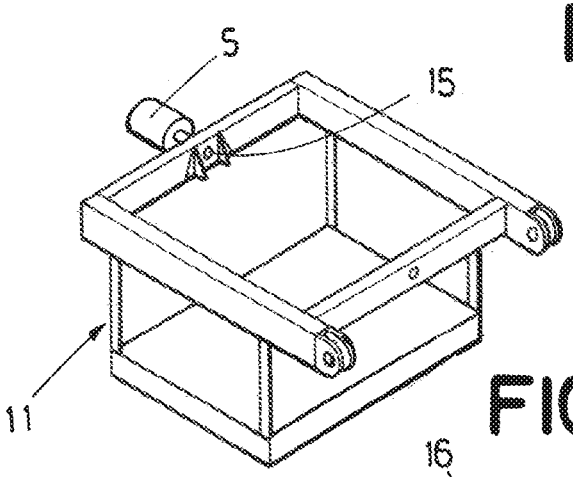
FIG. 12—It shows again a perspective of one of the floating cages in which the rollers are incorporated.
Figure 13:
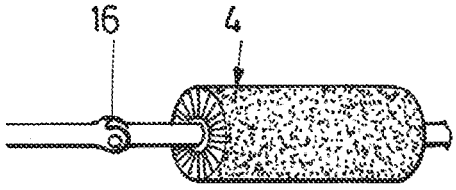
FIG. 13—It shows a perspective view of a roller, with its universal joint coupled to the motor attached to the cage.

In an alternative option, it is the structure (2) of the machine (1) that moves under the boat hull, for which, preferably, it is coupled to a horizontal movement mechanism (21), which, preferably, consists of a rail system that consists of, as can be observed in FIG. 11, besides a toothed rail (22) installed on the dock or jetty, a prolonged support (23) in the structure (2) where it incorporates support wheels (24) and, at least, a pinion (25) coupled to an additional traction, hydraulic or electric motor (25).

Preferably, in addition, the support wheels (24) are grooved metal wheels that run connected to one or two guide beams (27) parallel to the rail (22).

Thus, by activating this motor (26), it moves the pinion (25) determining its displacement along the rail (22) and, with this, it drags the entire structure (2) in order to make it move along the boat. The motor (26) is operated in one direction and the other, in order to move the machine in either direction.

In another realisation option, the structure (2) is designed in such a way that it combines the vertical movement mechanism (18) with the horizontal movement mechanism (21).

Optionally, the structure (2) has towing wheels (28) connected in its lower part to facilitate its transit outside the water.

Lastly, it can be indicated that, preferably, protections (29) of soft material have been provided in the points of the structure (2) and/or the cages (11) that can make contact with the boat hull to avoid scrapes.

Having described sufficiently the nature of this invention, as well as the way to put it into practice, it does not seem necessary to extend the explanation further as any expert in the subject may understand its scope and the advantages derived from it, emphasising that, within its essence, it can be carried out in other forms of realisation that differ in details to that indicated as an example, and which the sought protection will also cover, as long as it does not alter, change or modify its basic principle.

The invention claimed is:

1. A machine for cleaning boat hulls in the water comprising a structure (2) with an approximate U shape, which is installed submerged in the water held to a jetty or dock, a set of rollers (4) that comprise the following characteristics:

are fastened to the respective lateral frames (3)

rotate, driven by motors (5), are grouped with movable and flotation means in parallel rows (6)

slide perpendicularly along the length of the hull, in one direction or the other, adapting to its shape where the lateral frames (3) are movable in the vertical sense, by means of a hydraulic cylinder (7) and axles (8) inserted in respective slots (9) of the stanchions of the frame (2) with which they are connected in an articulated manner, the axles (8) present an enlargement on each end of the rod that comprise them (10), the rollers (4) are connected to a cage (11) that has a lower base of floating material (12) and the cages (11) are joined together, to make adaptable rows (6) of rollers held by their ends to the lateral frames (3) of the structure (2), by means of movable connections characterised in that the cages (11) are joined together by means of an articulated connection (13) provided on each side of the upper part of the framework that constitute them, and some sliding guides (14), also on each side, that connect the upper part of a cage (11) to the lower part of the next one, allowing each to swing independently.

2. The machine, according to claim 1, characterised in that each cage (11) is provided with an anchorage (15) for fastening the motor (5) which drives the roller (4), which, in turn, is coupled to the motor (5) by means of a universal joint (16), with all the rollers (4) remaining in both rows (6) with their motors (5) aligned axially.

3. The machine, according to claim 2, characterised in that the motors (5) of the rollers (4) are hydraulic, having provided an electric motor (17) which moves a hydraulic circuit that gives power to these hydraulic motors (5) of the rows (6) of rollers (4) individually to each one by means of a manual control system of levers.

4. The machine, according to claim 3, characterised in that, in addition, incorporates a longitudinal row (6'), with more rollers (4), fastened in the centre of the lower section of the structure (2).

5. The machine, according to claim 4, characterised in that it includes a vertically sliding mechanism (18) to adapt the position of the structure (2) to different drafts.

6. The machine, according to claim 5, characterised in that the vertical sliding mechanism (18) has an upper flotation stop (19) and a depth or draft stop (20).

7. The machine, according to claim 6, characterised in that the structure (2) moves below the boat hull, connected to a horizontal movement mechanism (21).

8. The machine, according to claim 7, characterised in that the horizontal movement mechanism (21) consists of a rail system (22).

9. The machine, according to claim 8, characterised in that it includes a toothed rail (22) installed on the dock or jetty, a prolonged support (23) in the structure (2) where it incorporates support wheels (24) and, at least, a pinion (25) coupled to an additional traction motor (26).

10. The machine, according to claim 9, characterised in that the support wheels (24) are grooved and run connected on one or two guide beams (27) parallel to the rail (22).

11. The machine, according to claim 6, characterised in that the structure (2) is fastened to the dock or jetty and the boat is moved over the rollers (4) by means of a winch that pulls it forwards and backwards.

12. The machine according to claim 11, characterised in that the structure (2) has towing wheels (28) connected in their lower part to facilitate its transit outside the water.

13. The machine, according to claim 12, characterised in that it has protections (29) of soft material in the points that could come into contact with the boat hull to avoid scrapes.

* * * * *